United States Patent [19]

Serikawa et al.

[11] Patent Number: 4,868,357

[45] Date of Patent: Sep. 19, 1989

[54] MICROWAVE HEATING APPLIANCE FOR AUTOMATICALLY HEATING AN OBJECT ON THE BASIS OF A DISTINCTIVE FEATURE OF THE OBJECT

[75] Inventors: Mitsuhiko Serikawa, Osaka; Sawako Usuki, Kobe; Katsuaki Sato, Osaka, all of Japan

[73] Assignee: Matsushita Electric Industrial Co., Ltd., Japan

[21] Appl. No.: 181,141

[22] Filed: Apr. 13, 1988

[30] Foreign Application Priority Data

| | | | |
|---|---|---|---|
| Apr. 14, 1987 | [JP] | Japan | 62-91342 |
| Jun. 24, 1987 | [JP] | Japan | 62-156826 |
| Sep. 7, 1987 | [JP] | Japan | 62-223462 |
| Nov. 17, 1987 | [JP] | Japan | 62-290009 |

[51] Int. Cl.[4] ..... H05B 6/68

[52] U.S. Cl. ..... 219/10.55 B; 219/10.55 F; 99/451

[58] Field of Search ..... 219/10.55 B, 10.55 R, 219/10.55 E, 10.55 F, 518; 73/620, 624; 99/451, DIG. 14, 325

[56] References Cited

U.S. PATENT DOCUMENTS

| | | | |
|---|---|---|---|
| 3,867,606 | 2/1975 | Peterson | 219/10.55 R |
| 4,434,341 | 2/1984 | Busby | 219/10.55 A |
| 4,672,180 | 6/1987 | Kusunoki et al. | 219/10.55 B |

FOREIGN PATENT DOCUMENTS 59-44793 3/1984 Japan .

*Primary Examiner*—Philip H. Leung

*Attorney, Agent, or Firm*—Lowe, Price, LeBlanc, Becker & Shur

[57] ABSTRACT

A microwave heating apparatus for heating an object for cooking which is placed on a turntable in a heating chamber. The microwave heating apparatus is arranged so as to automatically determining an appropriate heating condition of the object on the basis of a distinctive feature such as configuration and density of the object. The distinctive feature of the object is obtained by successively measuring a distance between the center of the turntable and a surface of the object. The measurement of the distance therebetween is performed by means of an ultrasonic transducer which is provided on a wall of the heating chamber so as to transmit an ultrasonic wave to the object and receive an echo wave from the object, the distance therebetween being obtained on the basis of the time between the transmission of the ultrasonic wave and the reception of the echo wave.

12 Claims, 6 Drawing Sheets

MICROWAVE HEATING APPLIANCE FOR AUTOMATICALLY HEATING AN OBJECT ON THE BASIS OF A DISTINCTIVE FEATURE OF THE OBJECT

BACKGROUND OF THE INVENTION

The present invention relates generally to automatic heating appliances, and more particular to a microwave oven having means for automatically determining an appropriate heating condition of an object to be heated for cooking purposes on the basis of a distinctive feature of the object.

One known heating appliance for heating an object, i.e., food, for cooking purposes is a microwave oven having various sensors whereby the heating of the object is automatically and appropriately effected on the basis of the sensed information such as temperature and humidity. The density of the object is also important cooking information necessary in order to perform the cooking in accordance with the class of the object to be heated. To obtain the object density, it may be necessary to know the weight and the volume or configuration of the object. One known way of obtaining information regarding the configuration of an object is disclosed, in Japanese Patent Provisional Publication No. 59-44793; automatic heating apparatus having a light source and an image pickup device arranged so that the configuration of an object to be heated is detected optically on the basis of an image produced on the image pickup device by a light ray from the light source. Important problems effecting such an optical type automatic heating appliance are dirt or stains deposited on the optical elements such as the lens with the passage of time and the generation of gases or vapors during heating which result in difficulty of an accurate recognization of the object configuration. Furthermore, this type of optical system may be limited in use to a particular type heating apparatus because of adverse effects caused by certain non-compatible heaters. Additionally, this type of optical system may involve high manufacturing costs because of the many parts required.

SUMMARY OF THE INVENTION

It is therefore an object of the present invention to provide an automatic microwave heating apparatus which is capable of accurately recognizing the configuration of an object with high reliability while being simple in structure.

The microwave heating apparatus comprises a heating chamber, a microwave generator for transmitting a microwave to an object to be heated, a turntable provided in the heating chamber to place the object thereon and to be rotatable about its own axis.. Also included in the microwave heating apparatus is an ultrasonic transducer provided on a wall of the heating chamber for transmitting an ultrasonic wave into the heating chamber and receiving an echo wave from the object and an inner surface of the heating chamber. The time between the transmission of the ultrasonic wave and the reception of the echo wave and, if required, the amplitude of the echo wave are measured so as to obtain a distinctive feature such as configuration and density of the object. The microwave generator is controlled in accordance with the obtained distinctive feature. Preferably, the microwave heating apparatus is arranged such that an ultrasonic wave emitted from the ultrasonic transducer is introduced through a reflecter and a through-hole defined in a wall of the heating chamber into the heating chamber and the echo wave from the object is received by the ultrasonic transducer through the through-hole and the reflecter. In order to obtain the distictive feature of the object, the distance between a surface of the object and the ultrasonic transducer is measured at every predetermined angle of rotation of the object cause by the to rotation of the turntable. The distance between the surface of the object and the center of the turntable is measured in order to obtain a partial cross-sectional area of the object which is obtained by the rotation of the predetermined angle. The sum of the thus obtained partial cross-sectional areas is calculated in response to one complete revolution of the object to estimate the configuration of the object on the basis of the calculated sum indicative of the entire cross-sectional area of the object. The partial cross-sectional area A is obtained in accordance with the following equation:

$$A=\theta \cdot Li \cdot Li/2$$

where $\theta$ represents the predetermined angle of rotation and Li represents the distance between the surface of the object and the center of the turntable.

BRIEF DESCRIPTION OF THE DRAWINGS

The object and features of the present invention will become more readily apparent from the following detailed description of the preferred embodiments taken in conjunction with the accompanying drawings in which.

DETAILED DESCRIPTION OF THE INVENTION

Figure 1:
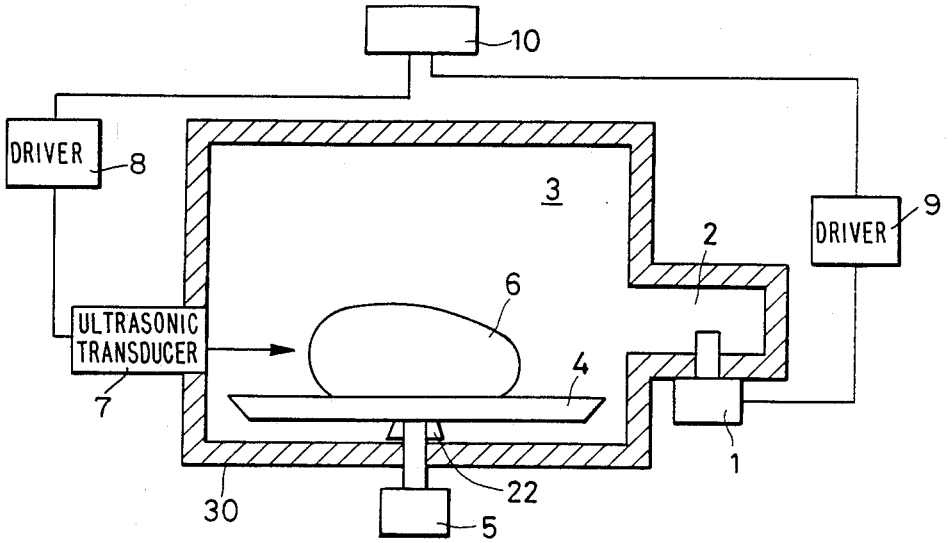
FIG. 1 is a cross-sectional view showing a microwave heating apparatus according to a first embodiment of the present invention.

Referring now to FIG. 1, there is schematically illustrated a microwave heating apparatus according to an embodiment of the present invention comprising a housing 30 and a heating device, i.e., magnetron, 1. A microwave from the magnetron 1 is introduced through a wave guide 2 into a heating chamber 3 so as to heat an object, i.e., food, 6 placed on a turntable 4 which is rotationally driven by means of a driving device or a motor 5. A weight sensor 22 is provided in connection with the turntable 4 to measure the weight of the food 6. Also included in the microwave heating apparatus is an ultrasonic sensor composed of an ultrasonic transducer 7 for transmission of an ultrasonic pulse toward the food 6 and reception of the echo thereof. Illustrated at numeral 10 in the drawing is a control unit 10 which includes a central processing unit and associated units for controlling the output of the magnetron 1 in accordance with information from the ultrasonic transducer 7 and the weight sensor 22 which are coupled thereto. On the other hand, in response to a control signal from the control unit 10, an ultrasonic transmission and reception control section (transducer driver) 8 supplies a transmission pulse signal to cause the ultrasonic transducer 7 to transmit an ultrasonic pulse and amplifies the echo wave and supplies a signal corresponding to the amplified echo wave to the control unit 10. Furthermore, in response to another control signal from the control unit 10, a magnetron drive control section (magnetron driver) 9 controls the output of the magnetron 1.

Operation of the microwave heating apparatus will be made hereinbelow. The control unit 10 supplies a control signal, at a short interval, to the ultrasonic transmission and reception control section 8 which in turn drives the ultrasonic transducer 7 to cause an ultrasonic wave to be intermittently transmitted to the food 6 at every small rotational angle of the food 6. The ultrasonic wave from the ultrasonic transducer 7 advances toward the food 6 placed at the turntable 4 and is reflected off a surface of the food 6. The reflected wave, i.e., echo wave, is received by the ultrasonic transducer 7 which produces a resulting received signal. The received signal is amplified by the ultrasonic transmission and reception section 8 and compared with an appropriate threshold to generate a signal indicative of the reception of the echo wave and a signal representing the amplitude of the echo wave which are supplied to the control unit 10. Control unit 10 measures the time period between the transmission and the reception in order to roughly recognize the configuration of the food 6. The control unit 10 further determines the class of the food 6 and an appropriate cooking sequence therefore on the basis of the recognized configuration and other information such as weight data from the weight sensor 22 and then controls magnetron drive control section 9 to control the output of the magnetron 1.

Figure 2A:
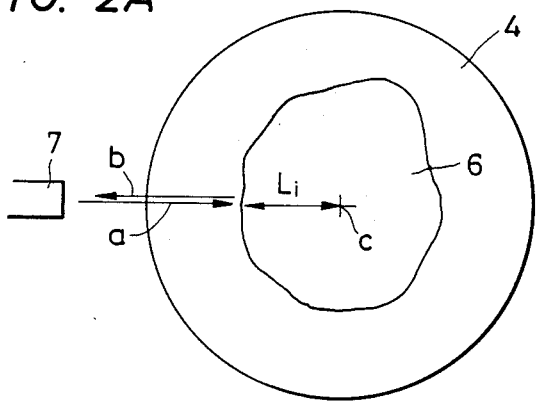
FIGS. 2A and 2B are illustrations for describing the calculation of a cross-sectional area of an object to be heated.
Figure 2B:
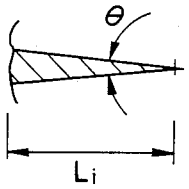

FIGS. 2A and 2B are illustrations for describing the recognization of the configuration of the food 6 and more specifically for describing the calculation of the cross-sectional area of the food 6, i.e., the projection area with respect to the turntable 4.

As illustrated in FIG. 2A, an ultrasonic wave emitted from the ultrasonic transducer 7 advances to the food 6 as illustrated by reference character a. Upon reaching the food 6, the ultrasonic wave is reflected off a portion of the surface of the food 6 and returns to the ultrasonic transducer 7 as illustrated by reference character b. If the distance between the ultrasonic transducer 7 and the center c of the turntable 4, i.e., the propagation time therebetween, is known in advance, it is possible to calculate the distance Li between the surface portion of the food 6 and the center c of the turntable 4 on the basis of the time between the transmission and the reception, i.e., the ultrasonic wave propagation time for the paths a and b. The ultrasonic wave is intermittently transmitted at every small rotational angle of the food 6 caused by rotation of the turntable 4. When the small rotational angle is $\theta$, it is understood from FIG. 2B that the cross-sectional area obtained due to rotation by $\theta$ has a triangular configuration and can be approximated by $\theta \cdot L1 \cdot Li/2$. Thus, the entire cross-sectional area can be obtained as the sum of the projection areas obtained at every rotational angle of the food 6, i.e., $\Sigma\theta \cdot Li \cdot Li/2$.

Figure 3:
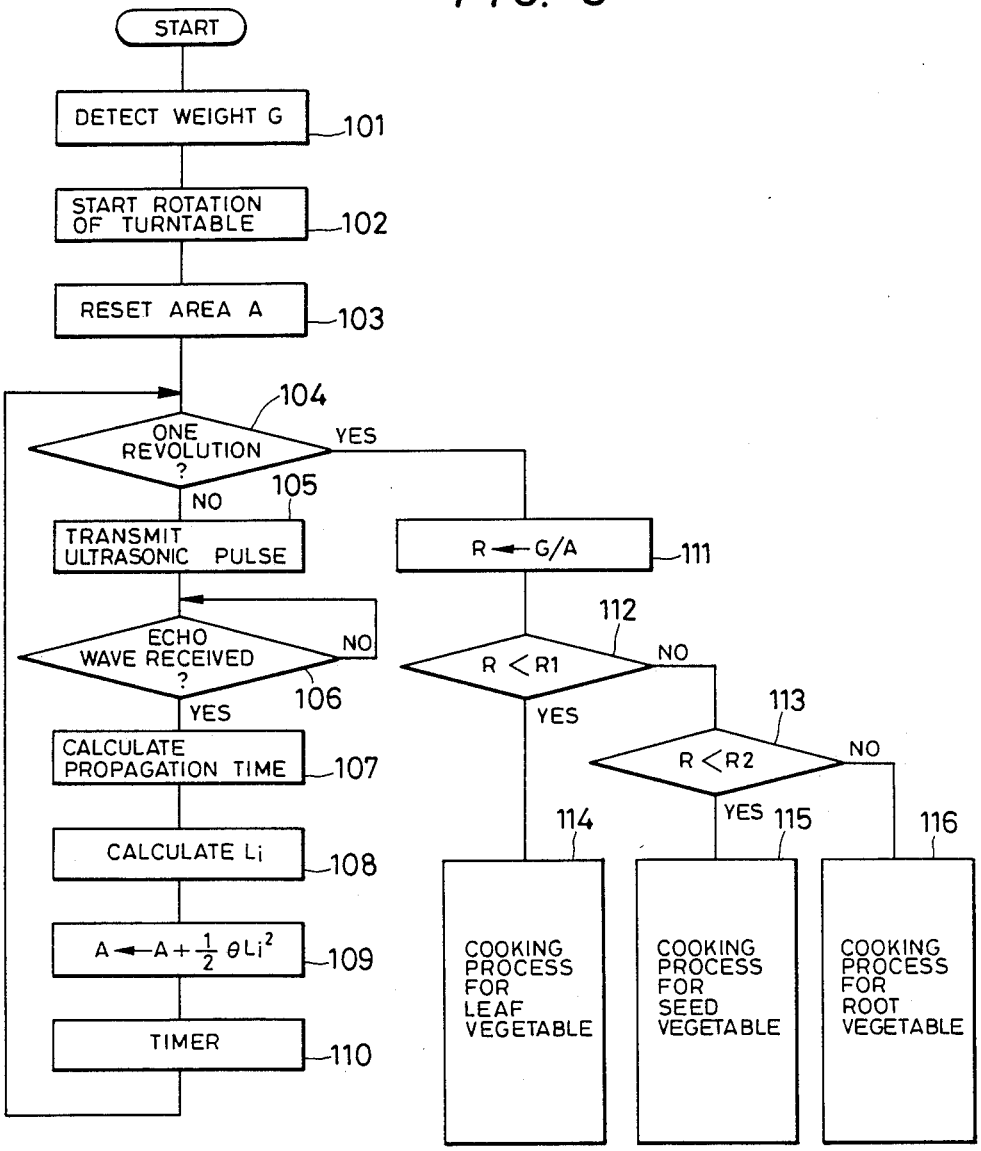
FIG. 3 is a flow chart for describing a method of obtaining the cross-sectional area of the object and a heating process of the object in accordance with a density calculated with the obtained cross-sectional area.

FIG. 3 is a flow chart showing an algorithm for calculating the cross-sectional area of the food 6 and for determinating a heating process to be used. Operation starts with step 101 which measure the weight G of the food 6 placed on the turntable 4 by means of the weight sensor 22. Next, step 102 starts rotation of the turntable 4 and is followed by step 103 which clears the previous cross-sectional area data. Control proceeds to step 104 which checks whether the turntable 4 has made one revolution i.e., checks whether the entire cross-sectional area has been obtained. If the turntable 4 has not made a complete revolution prior to step 104, an ultrasonic pulse is transmitted to the food 6 in step 105. After reception of the resulting echo wave in step 106, the time between the transmission of the ultrason pulse and the reception of the resulting echo wave is calculated in step 107 and is used to calculate the distance Li between the wave-reflected portion of the food 6 and the center of the turntable 4 in step 108. In response to the calculation of the distance Li, step 109 calculates the cross-sectional area corresponding to the rotation of the food by $\theta$ and adds this to the sum A of the already obtained cross-sectional areas. After execution of step 110, after elapse in which a predetermined time period required for the calculation has elapsed, the operational flow returns to step 104. When the turntable 4 has made one complete revolution, step 104 is followed by step 111 which calculates a surface density R by dividing the weight G by the obtained entire cross-sectional area A of the food 6. The calculated surface density R is compared with first and second references R1 and R2 to determine the class of the food and to perform a cooking process (heating time) in accordance with the determined class. For example, when the food 6 is a vegetable, the comparison results a determination of the kind of the vegetable, i.e., a leaf vegetable such as spinach, a seed vegetable such as broccoli or a root vegetable such as a potato and the heating time is controlled in accordance with the kind of the vegetable.

Figure 4A:
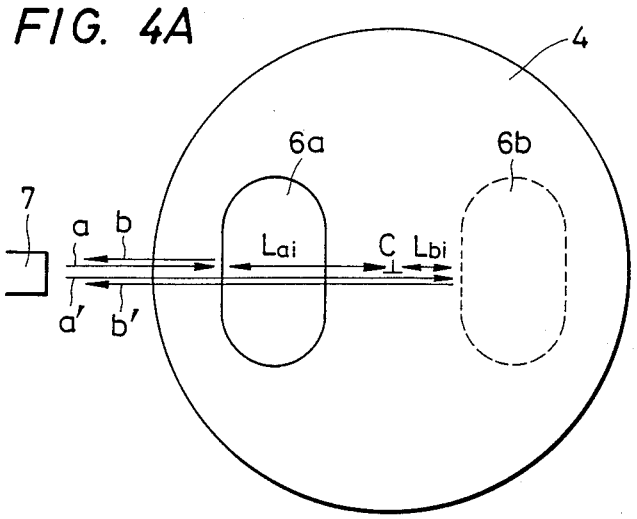
FIGS. 4A and 4B are illustrations for describing the calculation of a cross-sectional area of an object to be heated.
Figure 4B:
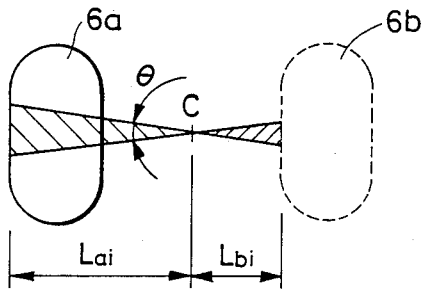

FIGS. 4A and 4B are illustrations for describing one example of calculations of the projection area in the case where the food 6 is placed on the turntable 4 in a position eccentric with respect to the center of the turntable 4. In FIGS. 4A and 4B reference numerals 6*a* and 6*b* represent different positions of the food 6 cause by the rotation of the turntable 4. In FIG. 4A, when the food 6 is at the position 6*a*, an ultrasonic wave emitted from the ultrasonic transducer 7 advances along a path a and returns thereto along a path b whereby the distance Lai between the center c of the turntable 4 and a surface portion of the food 6 is obtained. On the other hand, when the food 6 is at the position 6*b*, the ultrasonic wave emitted from the ultrasonic transducer reaches a surface portion of the food 6 along a path a' and being reflected therfrom to the ultrasonic transducer 7 along a path b', thus the distance Lbi between the center c of the food 6 is obtained and the surface portion thereof, Lbi having a sign inverse to that of Lai. Therefore, the cross-sectional area corresponding to a rotational angle $\theta$ of the turntable 4 can be approximately obtained as $\theta \cdot Lai \cdot Lai/2 - \theta \cdot Lbi \cdot Lbi/2$ in accordance with the measurements at the two positions which are different in rotational angle by 180° to each other. The entire cross-sectional area can be calculated as follows:

$$\Sigma\theta \cdot Lai \cdot Lai/2 - \theta \cdot Lbi \cdot Lbi/2.$$

The operation illustrated in FIG. 3 can be employed similarly for this case.

It will be understood from the above-description that it is possible to accurately obtain the configuration data of the food 6 required for the automatic cooking with a simple structure irrespective of generation of vapor or gas from the food 6. Furthermore, since the sensor, i.e., ultrasonic transducer 7, can be provided at the side wall of the heating chamber 3, a heater for heating the food 6 may be located at the ceiling thereof, if required. Although in the above description only the propagation time is used for the calculation of the cross-sectional area of the food 6, it is also appropriate that the surface state and hardness of the food 6 are additionally measured on the basis of the amplitude data of the echo waves. Furthermore, although in the above description a single ultrasonic transducer is provided for the measurement of the propagation time, it is further appropriate that a plurality of ultrasonic transducers are provided, so that further more accurate data relating to the volume or configuration of the food 6.

Figure 5:
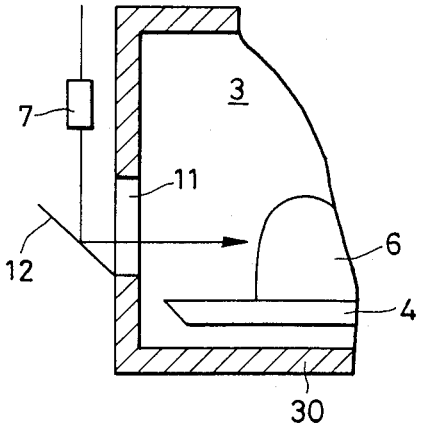
FIG. 5 is a partial cross-sectional view showing a modification of the FIG. 1 apparatus.

FIG. 5 is a partial illustration of a modification of the present invention in which parts corresponding to those in FIG. 1 are marked with the same reference numerals. In FIG. 5, numeral 11 represents a through-hole made at the side wall of a housing 30 and numeral 12 designates a reflecter placed near the through-hole 11. One difference between the FIG. 1 heating apparatus and the FIG. 5 heating apparatus is that the transmission and reception of an ultrasonic wave are effected through the reflecter 12. That is, the ultrasonic wave emitted from the ultrasonic transducer 7 is introduced through the reflecter 12 into a heating chamber 3 to reach the food 6 placed on a turntable 4. Then the reflected echo wave is received by the ultrasonic transducer 7 after reflection off the surface of the food 6 after striking the reflecter 12. This arrangement prevents attachment of oil and the like on the surface of the ultrasonic transducer 7 and results in preventing the ultrasonic transducer 7 from being placed under a high temperature atmosphere, which may result in deterioration of the performance of the ultrasonic transducer 7. Such an arrangement may be made so as to prevent the leakage of the microwave.

Figure 6:
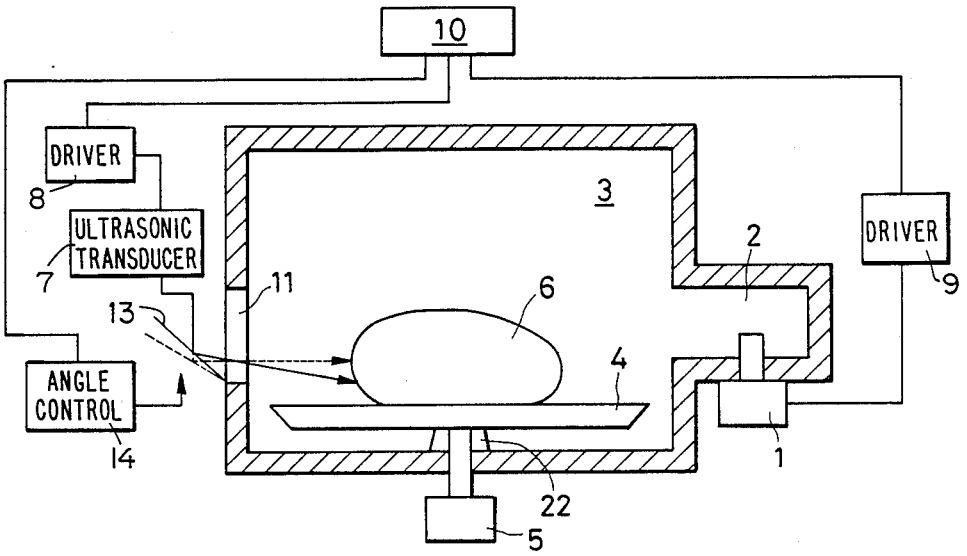
FIG. 6 is a cross-sectional view showing a microwave heating apparatus according to another embodiment of the present invention.
Figure 7:
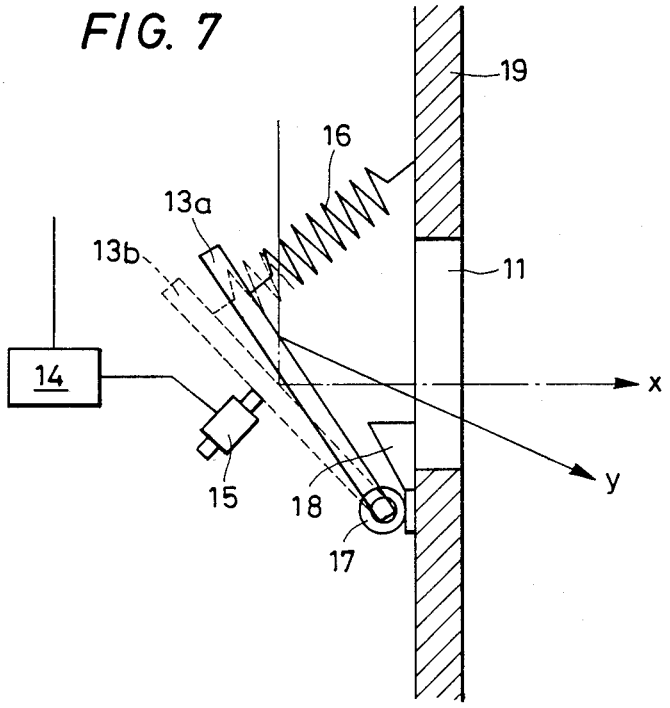
FIG. 7 is an illustration for describing in detail an arrangement for adjusting the position of the apparatus of a reflector of FIG. 6.
Figure 8:
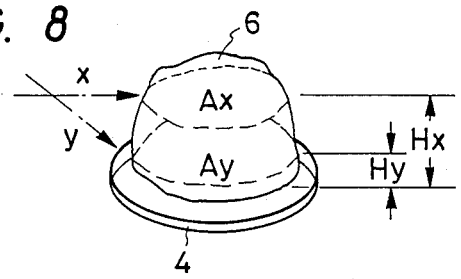
FIG. 8 is an illustration for describing how the cross-sectional area is obtained in accordance with transmitting angles of an ultrasonic wave to an object to be heated.

FIG. 6 is a cross-sectional view showing a microwave heating apparatus according to a third embodiment of the present invention in which parts corresponding to those in FIG. 1 or 5 are marked with the same reference numerals and the description thereof will be omitted for brevity. In FIG. 6, numeral 13 represents an angle-variable reflecter which is located near a through-hole 11 so as to allow for changes in the reflection angle. Numeral 14 depicts an angle control section for adjusting the reflection angle of the reflecter 13 in accordance with a control signal from a control unit 10. FIG. 7 is an enlarged detail view showing an arrangement which controls the angle of the angle-variable reflecter 13 with respect to the side plate 19 of the housing 30. In FIG. 7, one end portion of the reflecter 13 is coupled through a hinge portion 17 to the side plate 19 so as to be rotatable with respect thereto. The other end portion of the reflector 13 is coupled through a spring 16 to a portion of the side plate 19 which is in opposed relationship to the hinge-installed portion of the side plate 19 so that the through-hole 11 is interposed therebetween and the reflecter 13 is urged upwardly, i.e., clockwise in FIG. 7. A stopper portion 18 is provided near the hinge portion 17 whereby the reflecter 13 is kept at a position 13*a* against the biasing force of the spring 16. An electromagnet device 15 which is energized in response to a control signal from the angle control section 14 is also provided so that the reflecter 13 is rotationally moved up to a position 13*b* against the spring force 16. In this regard, at least a portion of the surface of the reflecter 13 facing the electromagnet device 15 is made of a material controllable by the electromagnet device 15. In FIG. 7, characters x and y represent directions, or paths, in which ultrasonic waves emitted from the ultrasonic transducer 7 are introduced into the heating chamber 3 in accordance with the positions 13*b* and 13*a* of the reflecter 13. With such an arrangement, a method calculation of a value substantially corresponding to the volume of the food 6 will be described with reference to FIG. 8. In FIG. 8, character Ax represents a cross-sectional area which is calculated in accordance with an ultrasonic wave signal transmitted along the path x and which is positioned at a height of Hx. Character Ay designates a cross-sectional area which is calculated in accordance with an ultrasonic wave signal transmitted along the path y and which is positioned at a height of Hy. In response to rotation of the food 6 placed on the turntable 4; the control unit 10 initially generates a control signal to the angle control section 14 so that the angle-variable reflecter 13 is at the position 13*b* by means of the electromagnet device 15. In this position of the reflecter 13, the cross-sectional area Ax at the height of Hx is calculated using an ultrasonic wave transmitted along the path x as in the above-mentioned first embodiment. Next, the control unit 10 generates another control signal to the angle control section 14 so that the electromagnet device 15 is de-energized causing the angle-variable reflecter 13 to move up to the position 13*a* by means of the spring force 16. In this second position; the calculation of the cross-sectional area Ay at the height of Hy is made by means of an ultrasonic wave transmitted along the path y in a manner similar to that described above.

Thus, in this embodiment a single ultrasonic transducer 7 allows measurements of a plurality of different cross-sectional areas of the food 6, resulting in obtaining a further accurate configuration, or volume, data relating to the food 6.

Figure 9:
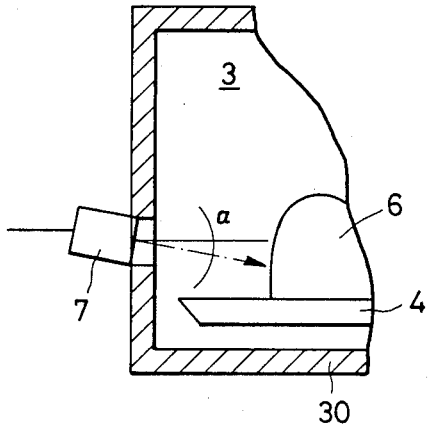
FIG. 9 is a partial cross-sectional view showing a microwave heating apparatus according to a further embodiment of the present invention.

FIG. 9 shows a portion of a microwave heating apparatus according to a fourth embodiment of the present invention in which parts corresponding to those in FIGS. 1 and 6 are marked with the same reference numerals. One difference between the FIG. 1 embodiment and the FIG. 9 embodiment is that an ultrasonic transducer 7 is provided in a through-hole defined in the side plate of a housing 30 so that its wave-emitting surface is faced, or inclined, obliquely and downwardly by an angle of $\alpha$ as shown in FIG. 9. This position of the ultrasonic transducer provides for stability and ease of reception of the reflected wave. Furthermore, since in this arrangement an ultrasonic wave emitted from the ultrasonic transducer 7 is directed downwardly to the food 6, the reflection of the wave occurs at the surface of the food 6 and more easily at the surface of the turntable 4. Since the reflected waves return not only from the surface of the food 6 but also from the surface of the turntable 4 to the ultrasonic transducer 7, there is an increase in reception of the echo wave signal and hence a more accurate measurement of the food 6 is possible.

Figure 10A:
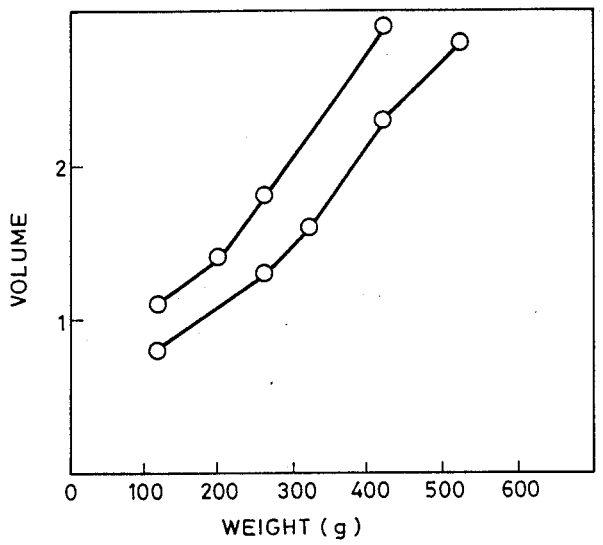
FIGS. 10A and 10B show the results obtained in accordance with different transmitting angles of an ultrasonic wave to an object.
Figure 10B:
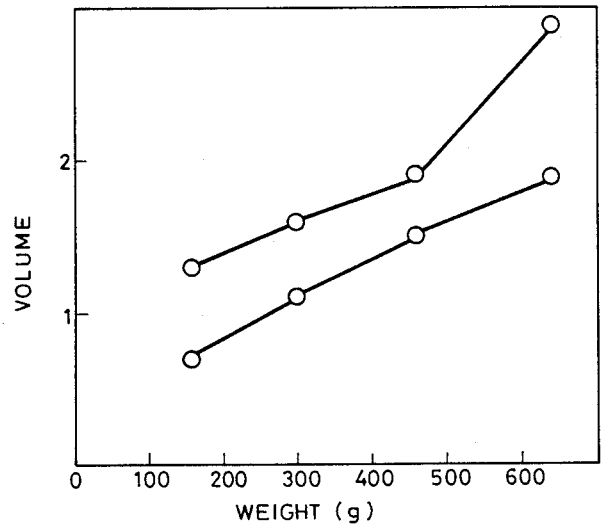

FIG. 10A is a graphic illustration for describing the measurement results in the case wherein the ultrasonic wave is transmitted downwardly from the ultrasonic transducer 7. In FIG. 10 the vertical axis represents volume data obtained from one kind of food whose size or amount is varied stepwise. The horizontal axis represents weight data thereof. The volume data is the maximum volume value and the minimum volume value which are measured when the food weight is constant. FIG. 10B is also a graphic illustration for describing the measurement results in the case wherein the ultrasonic wave is horizontally transmitted toward the same food and where the amount of the food is varied stepwise. The difference between the maximum and minimum volume values at each measurement in the downward transmitting case is smaller as compared to the difference therebetween in the horizontally transmitting case. This means that the downward transmission results in more accurate measurement.

Figure 11:
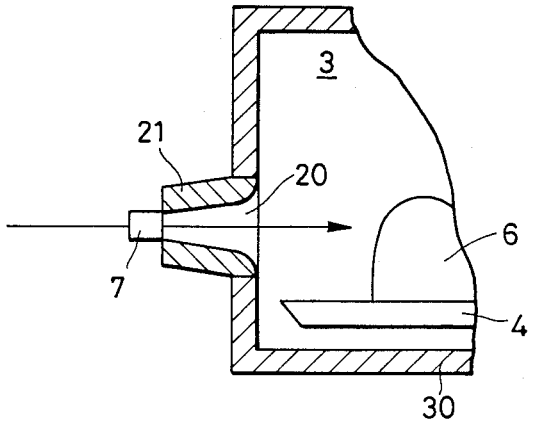
FIG. 11 is a partial cross-sectional view showing a microwave heating apparatus according to a still further embodiment of the present invention.

FIG. 11 shows a portion of a microwave heating apparatus according to a fifth embodiment of the present invention in which parts corresponding to those in FIGS. 1 and 6 are marked with the same reference numerals. One important feature of this embodiment is that a horn portion 21, having at its one end a throat portion, is provided on the side plate of a housing 30 so that the other end covers a through-hole 20 defined thereat additionally an ultrasonic transducer 7 is provided at the throat portion so that an ultrasonic wave provided by the ultrasonic transducer 7 is introduced through the horn portion 21 and the through-hole 20 into a heating chamber 3. This arrangement causes improvement in the transformation efficiency between the transmission and reception of the ultrasonic wave and allows the directional control of the emitted ultrasonic, resulting in easier measurement of the food 6. Here, the configuration of the horn portion 21 is not limited to that shown in FIG. 11.

It should be understood that the foregoing relates to only preferred embodiments of the invention, and that it is intended to cover all changes and modifications of the embodiments of this invention herein used for the purposes of the disclosure, which do not constitute departures from the spirit and scope of the invention.

What is claimed is:

1. A microwave heating apparatus with heating chamber comprising:

microwave generating means for transmitting a microwave to an object which is encased in said heating chamber;

measuring means disposed in a wall of said heating chamber for measuring a distance between a side wall of said heating chamber and said object; and determining means coupled to said measuring means for determining a cross-sectional area of said object in accordance with the result of the measured distance.

2. A microwave heating apparatus as claimed in claim 1, wherein said measuring means comprises at least one ultrasonic transducer.

3. A microwave heating apparatus with a heating chamber comprising:

microwave generating means for transmitting a microwave to an object, which is placed in said heating chamber, so as to heat said object;

turntable means provided in said heating chamber for receiving said object to be heated, said turntable means being arranged to be rotatable about its own axis;

drive means for driving said turntable means so as to cause rotation of said turntable means;

ultrasonic transducer means for transmitting an ultrasonic wave into said heating chamber and for receiving an echo wave from said object and a wall of said heating chamber; and means coupled to said ultrasonic transducer means for measuring a time between the transmission of said ultrasonic wave and reception of the echo wave and for further measuring the amplitude of the echo wave and for determining a shape of said object in accordance with the results of the measurements of the time and amplitude.

4. A microwave heating apparatus as claimed in claim 3, wherein said ultrasonic transducer means is provided at the outside of said heating chamber and an ultrasonic wave transmitted from said ultrasonic transducer means is introduced through a reflector and a through-hole defined in a wall of said heating chamber into said heating chamber and the echo wave from said object is received by said ultrasonic transducer means through said through-hole and said reflector.

5. A microwave heating apparatus as claimed in claim 4, wherein said reflector is pivotally provided on an outer surface of said heating chamber so that the angle of said reflector with respect to said outer surface is variable.

6. A microwave heating apparatus as claimed in claim 4, wherein said reflector is arranged such that the ultrasonic wave transmitted from said ultrasonic transducer means advances downwardly into said heating chamber at an angle of 85° to 70° with respect to the support surface of the turntable.

7. A microwave heating apparatus as claimed in claim 4, further comprising a hollow horn having openings, one of said openings being coupled to said through-hole so as to cover said through-hole and another of said openings being connected to said ultrasonic transducer means so that the ultrasonic wave transmitted through from said ultrasonic transducer means is introduced through the inside of said horn and said through-hole into said heating chamber.

8. A microwave heating apparatus as claimed in claim 7, wherein said horn and the wall of said heating chamber are integrally formed to each other.

9. A microwave heating apparatus is claimed in claim 3, wherein said ultrasonic transducer is arranged such that the ultrasonic wave transmitted from said ultrasonic transducer means advances into said heating chamber at an angle of 85° to 70° with respect to the support surface of the turntable.

10. A microwave heating apparatus as claimed in claim 9; wherein a through-hole is defined in a wall of said heating chamber and said ultrasonic transducer means is coupled through a hollow horn to said through-hole so that the ultrasonic wave transmitted from said ultrasonic transducer means is introduced through the inside of said horn and said through-hole into said heating chamber.

11. A microwave heating apparatus as claimed in claim 3, wherein said shape-determining means measures a distance between a surface of said object and said ultrasonic transducer means at every predetermined angle of rotation of said object caused by the rotation of said turntable means and thereby determines a distance between the surface of said object and the center of said turntable means and obtains a partial cross-sectional area of said object which is obtained by the rotation of the predetermined angle about the center of said turntable means, said shape-determining means further calculates the sum of the partial cross-sectional areas in response to one revolution of said object on said turntable so as to determine the shape of said object on the basis of the calculated sum.

12. A microwave heating apparatus as claimed in claim 11, wherein the partial cross-sectional area A is obtained in accordance with the following equation:

$$A=\theta \cdot Li \cdot Li/2$$

where $\theta$ represents the predetermined angle of rotation and Li represents the distance between the surface of said object and the center of said turntable means.

* * * * *